United States Patent [19]

Yogo

[11] Patent Number: 4,727,738

[45] Date of Patent: Mar. 1, 1988

[54] BENDING APPARATUS

[75] Inventor: Teruaki Yogo, Nagoya, Japan

[73] Assignee: Kabushikikaisha Chuodenkiseisakusho, Japan

[21] Appl. No.: 942,130

[22] Filed: Dec. 16, 1986

[30] Foreign Application Priority Data

May 31, 1986 [JP] Japan ..... 61-127809
Oct. 13, 1986 [JP] Japan ..... 61-242297

[51] Int. Cl.[4] ..... B21D 7/04
[52] U.S. Cl. ..... 72/157
[58] Field of Search ..... 72/149, 153, 154, 155, 72/157, 158, 159, 320, 321

[56] References Cited

U.S. PATENT DOCUMENTS 4,063,441 12/1977 Eaton ..... 72/155 X
4,236,398 12/1980 Schwarze ..... 72/157
4,552,006 11/1985 Yogo ..... 72/149

FOREIGN PATENT DOCUMENTS 2101162 7/1972 Fed. Rep. of Germany ..... 72/157

*Primary Examiner*—E. Michael Combs
*Attorney, Agent, or Firm*—Pollock, Vande Sande & Priddy

[57] ABSTRACT

A bending template assembly is attached to a main shaft mounted in an elongated bed and is provided with a plurality of bending templates put in layers in the axial direction of the main shaft. A long work is held, at the rear end thereof, in a chuck mounted on a carriage for work slidable in the longitudinal direction of the work. The chuck is movable transversely to the work, i.e., horizontally and vertically and the work can be located against the outer periphery of desired one of the plural bending templates by the horizontal and vertical displacement of the chuck. A fastening apparatus provided with fastening pieces of the number equal to that of the bending templates is disposed on a bending arm mounted on the main shaft at one end thereof. This fastening apparatus is not only rotatable together with the bending arm but also movable horizontally and vertically relative to the bending arm and can be approached or retreated from the bending template assembly. When the fastening apparatus is retreated the choice of bending templates by the carriage for work is carried out. When the fastening apparatus is approached to the bending template assembly the work is held between one of the bending templates and corresponding one of the fastening pieces and the bending arm is turned to form bends on the work.

5 Claims, 10 Drawing Figures

BENDING APPARATUS

BACKGROUND OF THE INVENTION

1. Field of the Invention

The present invention relates to a bending apparatus to bend a long work such as a pipe or a rod. Particularly a bending apparatus in which a work can be fed not only along a horizontal plane but also be moved along a vertical plane against one of plural bending templates of different radii that are placed vertically one upon another.

2. Description of the Prior Art

In one of the apparatuses of the above mentioned type according to the prior art, a work is fed longitudinally into contact with a bending template and is pressed against the bending template by a fastening apparatus which is movable in the direction perpendicular to the longitudinal direction of the work. The template and the fastening apparatus hold the work to be bent closely therebetween and are turned together with the work, by the end portion of a bending link, around the center of curvature of a bend to be formed. The desired portion of the work is thus bent. In the apparatus of this type, however, the radii of curvature of bends to be formed on plural portions of the work are all the same or otherwise the bending template must be exchanged each time if bends of different radii of curvature are to be formed. The operation of exchanging templates takes a long time and is very troublesome. Furthermore, relative positions of a series of bends to be formed on the same work apt to be inaccurate since an old bending template must be removed from a mount axis thereof in order to exchange bending templates, and the work and the fastening apparatus have to be positioned against a new bending template.

As an apparatus in which the above mentioned problems have been settled, a bending apparatus is known which is provided with a series of bending templates of different radii arranged coaxially around a vertical axis and movable axially. Since each of the bending templates of such an apparatus needs a certain radial thickness, it is impossible to select an arbitrary radius for each template and the radii of templates become considerably discrete. For this reason it is impossible with this apparatus to form some bends of arbitrarily close radii. Furthermore, a play for insertion and axial displacement must be formed between two adjacent bending templates disposed coaxially. When a bending template of a large radius is used, several plays of the above mentioned type, for some bending templates of smaller radii located inside the template, are added one after another, resulting in a larger play and precise bending operation can not be expected.

SUMMARY OF THE INVENTION

An object of the present invention is accordingly to provide an apparatus for bending a long workpiece such as a pipe or a rod in which improvements have been made on the above mentioned devices of the prior art.

Another object of the present invention is to provide a bending apparatus which makes it possible to bend plural portions of a single work into bends of different, large and small, radii.

A still other object of the present invention is to provide a bending apparatus which makes it possible to deform a single work into bends formed along planes oriented in different directions.

A still other object of the present invention is to provide a bending apparatus in which the radii of curvature of bends formed on a work can be quickly varied.

A still other object of the present invention is to provide a bending apparatus in which the direction of planes of bends formed on a work can be quickly varied.

A still other object of the present invention is to provide a bending apparatus including bending templates, a fastening apparatus to press a work against one of the bending templates and a bender-driving apparatus for turning both the bending templates and the fastening apparatus.

A still other object of the present invention is to provide a bending apparatus including a carriage for work which feeds a work forward in order to form a series of bends of different radii on plural positions of the work in succession from the front end to the rear end of the work.

A still other object of the present invention is to provide a bending apparatus which is provided with plural bending templates of mutually different radii for the purpose of deforming plural portions of a work into bends of different radii.

A still other object of the present invention is to provide a bending apparatus which is provided with a horizontally movable base and a vertically movable base both mounted on a carriage for a work so that the work located already against a bending template can be further located against another bending template as well.

A still other object of the present invention is to provide a bending apparatus which includes a rotatable chuck mounted on a carriage for work for the purpose of varying the direction of a plane of bend.

A still other object of the present invention is to provide a bending apparatus which makes it possible to form bends at plural portions from the front end to the rear end of a work, further to change a position for bend formation by providing a longitudinal feed to the work during the time interval between two successive bend formations, to change a radius of curvature by moving the work both horizontally and vertically and by locating the work against a bending template of a different radius of curvature, and to change the direction of a plane of bend by rotating the work when the direction of each plane of bend and each radius of curvature are to be varied, i.e., to provide a bending apparatus in which the above mentioned three kinds of changes can be effectuated just by displacing the work in the longitudinal direction thereof.

A still other object of the present invention is to provide a bending apparatus in which a series of bends of arbitrarily close radii of curvature can be formed on plural portions of a work.

Other objects and advantages of the present invention will become apparent during the following description taken in conjunction with the accompanying drawings.

DETAILED DESCRIPTION OF THE PREFERRED EMBODIMENTS

Figure 1:
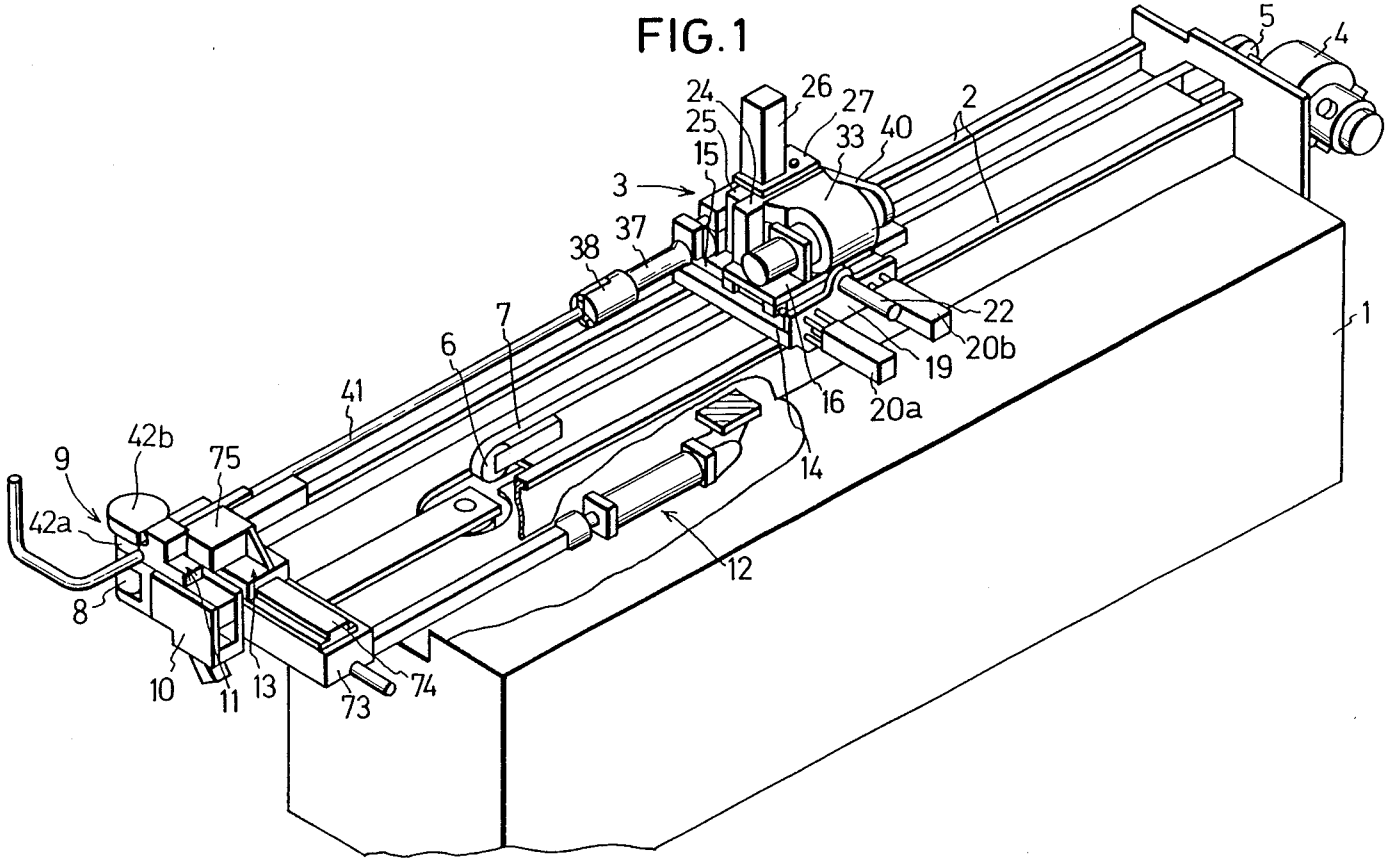
FIG. 1 is a perspective view showing a whole bending apparatus according to the present invention.

Referring mainly to FIG. 1, a bending apparatus according to the present invention includes an elongated bed 1 provided, on the top surface thereof, with a pair of parallel rails 2. The rails 2 are disposed in parallel to the longitudinal direction of the bed 1. On the rails 2, is slidably mounted a carriage 3 for work and is adapted to be longitudinally driven by an arbitrarily chosen distance by a geared motor 4 secured at the rear end of the bed 1 through chain sprockets 5,6 and a chain 7 stretched therebetween. At the front end of the bed 1, a main shaft 8 is mounted so that it can be vertically held and be rotatable. On the main shaft 8, a bending template assembly 9 and a bending arm 10 are mounted for free rotation relative to the bed 1. A fastening apparatus 11 is provided on the bending arm 10 so that the fastening apparatus 11 may turned together with the bending arm 10 but be vertically movable relative to the arm 10 and be horizontally movable in the radial direction perpendicular to the turning direction of the arm 10. A bender-driving apparatus 12 is put inside the bed 1 and the front end portion thereof is pivotally connected to and to be adapted to turn the bending arm 10. A numeral 13 represents a supporting apparatus.

Figure 8:
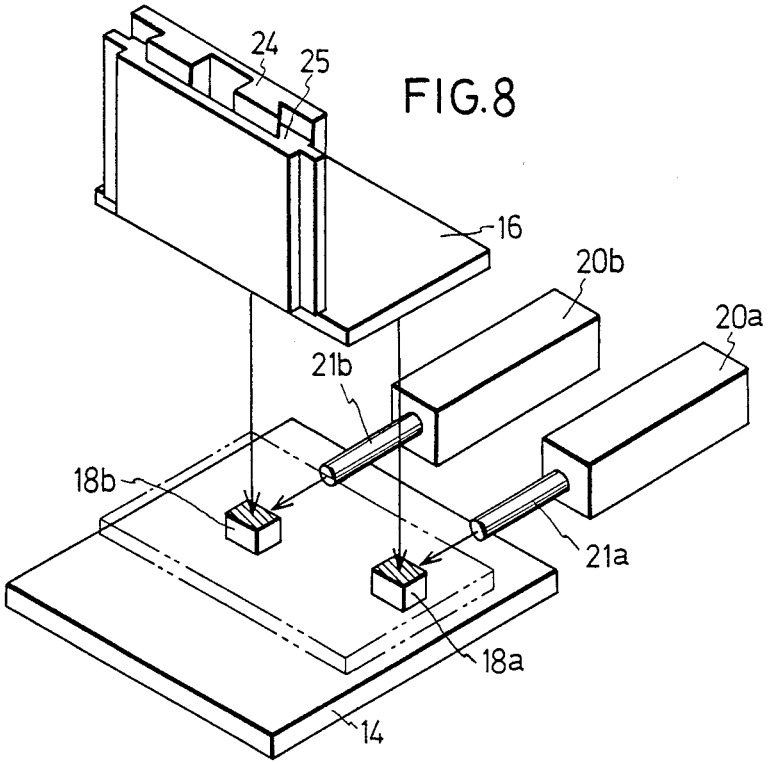
FIG. 8 is a perspective view of the decomposed major components carrying out the horizontal movement of the carriage for work.

Next referring to FIGS. 6 through 10, the carriage 3 for work is described in details. A carriage base 14 movable on the rails 2 in the direction shown by arrows A3 is secured on the chain 7 and a pair of parallel linear guides 15 are fixed on the carriage base 14 transversely to the bed, i.e., at right angles to the rails 2. A horizontally movable base 16 is slidably mounted, at four sliding pieces 17 secured on the reverse side thereof, on the linear guides 15. As is best seen in FIG. 8, abutting pieces 18*a*, 18*b* are secured on the reverse side of the horizontally movable base 16. At one end side of the linear guides 15, an upright wall 19 is attached to one side surface of the carriage base 14. On the upright wall 19 are secured hydraulic cylinders 20*a*, 20*b* whose respective rods 21*a*, 21*b* are adapted to move in parallel to the linear guides 15 through holes bored in the upright wall 19. The aforementioned abutting pieces 18*a*, 18*b* are disposed on straight lines coinciding with the axes of the rods 21*a*, 21*b* respectively and are adapted to be pushed by the tops of the rods 21*a*, 21*b*, driving the horizontally movable base 16 in the direction away from the upright wall 19 as the rods 21*a*, 21*b* protrude forward. An air cylinder 22 is similarly mounted on the upright wall 19. A rod 22*a* of the air cylinder 22 is inserted, for forth and back movement, through a hole bored in the upright wall 19 and is connected, at a knuckle joint 23 attached to the top thereof, to the horizontally movable base 16. The air cylinder 22 is adapted to pull the horizontally movable base 16 back towards the upright wall 19.

Figure 9:
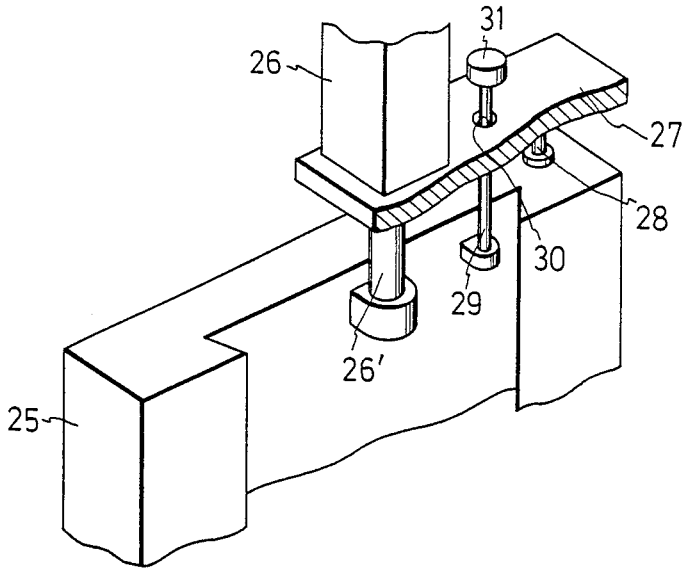
FIG. 9 is a fragmental perspective view of the components locating a vertically movable base on the carriage.

The horizontally movable base 16 is integrally provided, at the side thereof opposite to the upright wall 19, with a vertical dovetail block 24. A vertically movable base 25 is dovetailed with the dovetail block 24 for free vertical movement. As shown in FIGS. 1 and 9, a hydraulic cylinder 26 is mounted on a cylinder mount 27 secured to the dovetail block 24. A rod 26' of the hydraulic cylinder 26 is passed through the cylinder mount 27 and is connected, at the top thereof, to the upper portion of the vertically movable base 25. A stopper rod 28 is extending from the lower surface of the cylinder mount 27 and the upper position of the vertically movable base 25 is determined by the tip of the stopper rod 28 abutting the upper surface of the vertically movable base 25. A stopper bolt 29 is loosely inserted through a hole 30 and the lower end thereof is connected to the upper portion of the vertically movable base 25 and the upper end thereof extending over the upper portion of the cylinder mount 27 is provided with a head 31 of a radius larger than the radius of the hole 30. The lower position of the vertically movable base 25 is determined by the lower edge of the head 31 contacting with the upper surface of the cylinder mount 27.

Figure 10:
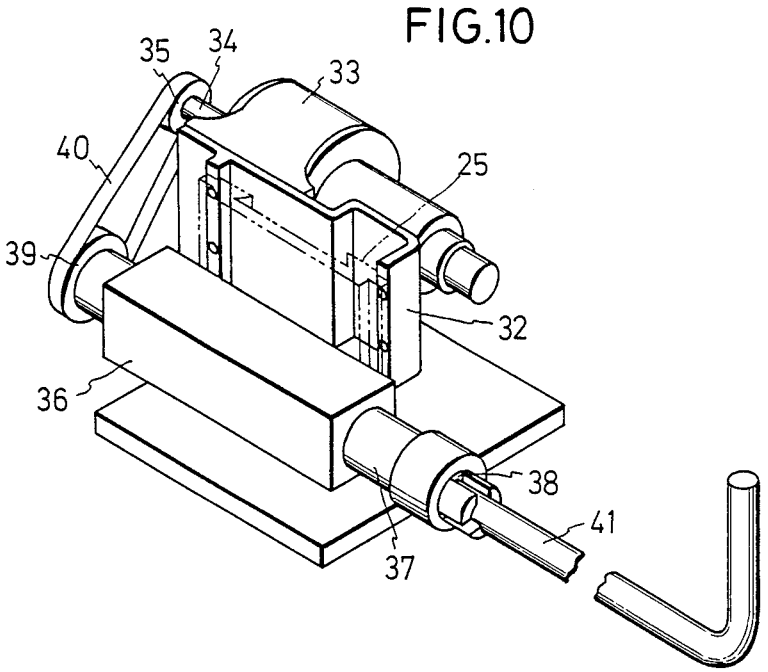
FIG. 10 is a perspective view of a chuck provided on the carriage for work and a mechanism to rotate the chuck.

As shown in FIG. 10, a vertical motor base 32 is disposed on the vertically movable base 25 in such a positional relation as surrounding the dovetail block 24. On the motor base 32 is mounted a geared motor 33 and a driving shaft 34 thereof is provided with a timing pulley 35.

A spindle case 36 is secured on the vertically movable base 25 so that it may be in parallel to the rails 2. A hollow shaft 37 is rotatably supported inside the spindle case 36 and a chuck 38 is mounted on the front end of the spindle shaft 37. A timing pulley 39 is mounted on the rear end of the spindle shaft 37 and a timing belt 40 is stretched between timing pulleys 35 and 39. When the rear end of a work 41 to be bent, such as a pipe or a rod, is held in the chuck 38, the work 41 can be maintained in parallel to the rails 2 and is rotatable around the axis thereof.

Figure 2:
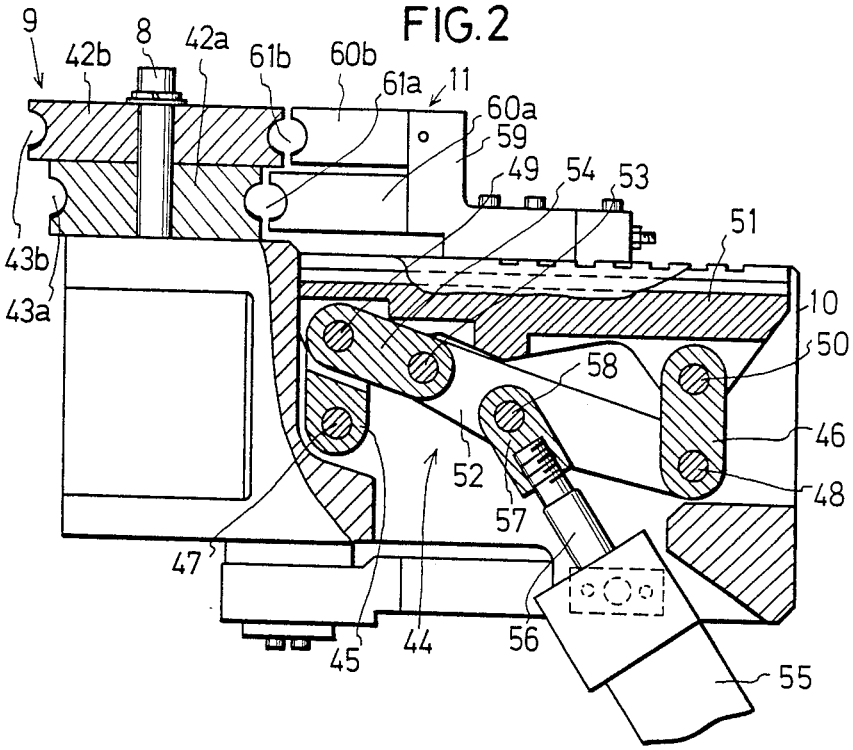
FIG. 2 is a side elevation partially in section showing a bending template assembly and a fastening apparatus which is raised to an upper position and brought close to the bending template assembly.
Figure 3:
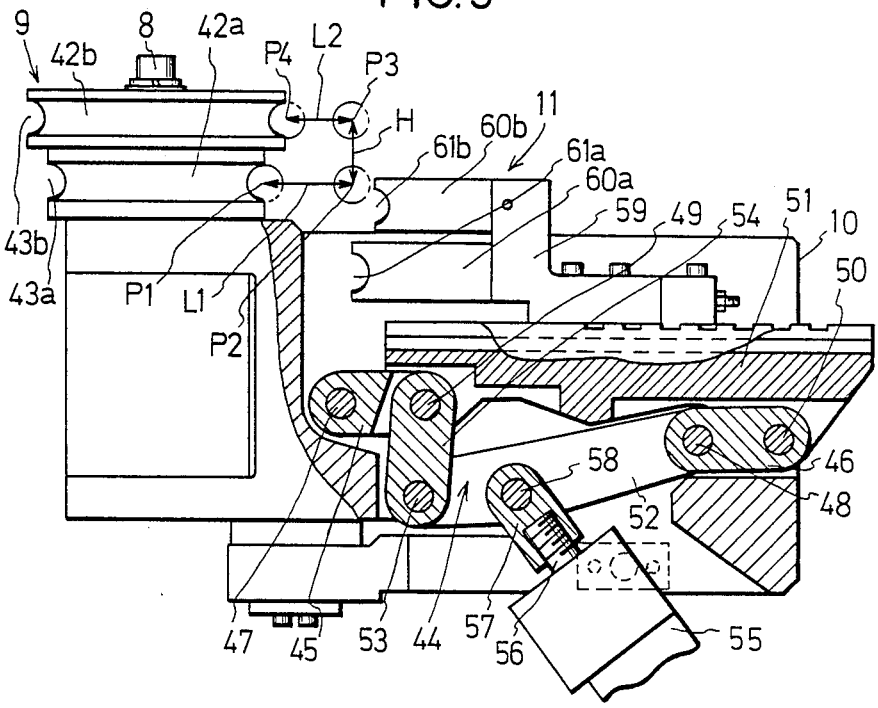
FIG. 3 is a view similar to FIG. 2 with the fastening apparatus lowered to a lower position and retreated from the bending template assembly.

Next, the bending template assembly 9, the bending arm 10 and the fastening apparatus 11 are explained in details in reference to FIGS. 2 and 3. Two substantially circular bending templates 42*a*, 42*b* are put in layers vertically in the axial direction and are mounted on the main shaft 8. On the outer circumference of the lower bending template 42*a* is formed a groove 43*a* having a cross section conforming to half the outer circumference of the work 41. The upper bending template 42*b* is formed with a radius larger than that of the lower bending template 42*a* and is provided, at the outer circumference thereof, with a similar groove 43*b*. The bending template 42*a* is located in such a manner that the work 41 held in the chuck 38 can be fitted in the groove 43*a* when the rod 21*a* of the aforementioned hydraulic cylinder 20*a* extends fully and the lower edge of the head 31 of the stopper bolt 29 contacts with the upper surface of the cylinder mount 27. The upper bending template 42*b* is located in such a manner that the work 41 can be fitted in the groove 43*b* when the work 41 is at the height determined by the contact of the upper surface of the vertically movable base 25 with the lower end of the stopper rod 28 and at the horizontal position determined by the full extension of the rod 21*b* of the hydraulic cylinder 20*b*.

A fastener-driving mechanism 44 is now explained which is put inside a frame of the bending arm 10. A pair of parallel links 45, 46 are pivotally connected, at respective one ends thereof, to the bending arm 10 by pins 47, 48 respectively and the other ends thereof support a fastener base 51 at pins 49, 50. One end of a driving lever 52 is pivotally connected to one end of a toggle link 54 by a pin 53 and the other end of the toggle link 54 is pivotally connected to the fastener base 51 by a pin 49. The other end of the driving lever 52 is pivotally connected to the frame of the bending arm 10 by the pin 48. A hydraulic cylinder 55 is secured under the bending arm 10 and a rod 56 thereof is disposed so that it may move obliquely forth and back in a vertical plane. A joint 57 is screwed to the top of the rod 56 and the joint 57 is pivotally connected to the intermediate portion of the driving lever 52 by a pin 58. An L-shaped holder 59 is fixed on the top surface of the fastener base 51 and to the vertical wall of the holder 59 are attached fastening pieces 60*a*, 60*b* in such a positional relation that they overlap each other in the vertical direction. Fastening pieces 60*a*, 60*b* are provided, at the front surfaces thereof, with grooves 61*a*, 61*b* having cross sectional forms similar to those of grooves 43*a*, 43*b*. The fastener base 51 and the fastener-driving apparatus 44 are located so that the fastening piece 60*a* approaches to and is opposed to the bending template 42*a* and the fastening piece 60*b*, to the bending template 42*b* as shown in FIG. 2. As the rod 56 is retreated, the fastening pieces 60*a*, 60*b* are adapted to leave the bending templates 42*a*, 42*b* radially, to descend simultaneously and to be retreated from the bending template assembly 9 along an arcing curve in a vertical plane.

Figure 4:
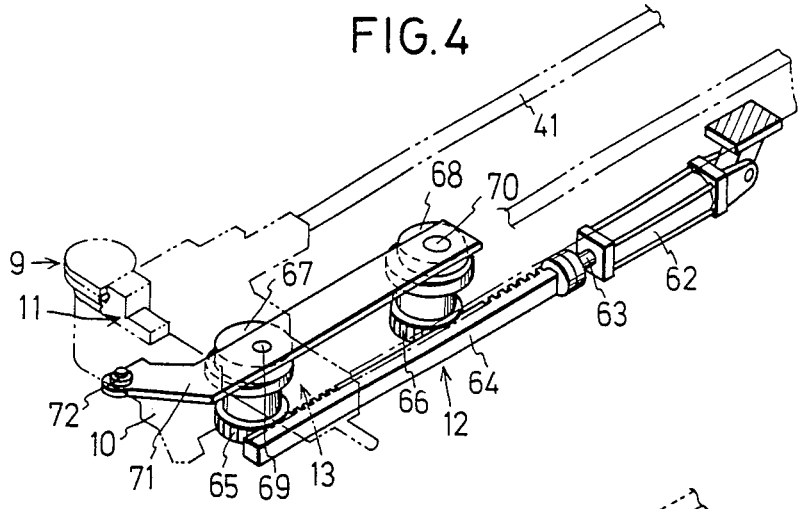
FIG. 4 is a perspective view of a bender-driving apparatus in such a situation that it has not turned the bending template assembly and the fastening apparatus.
Figure 5:
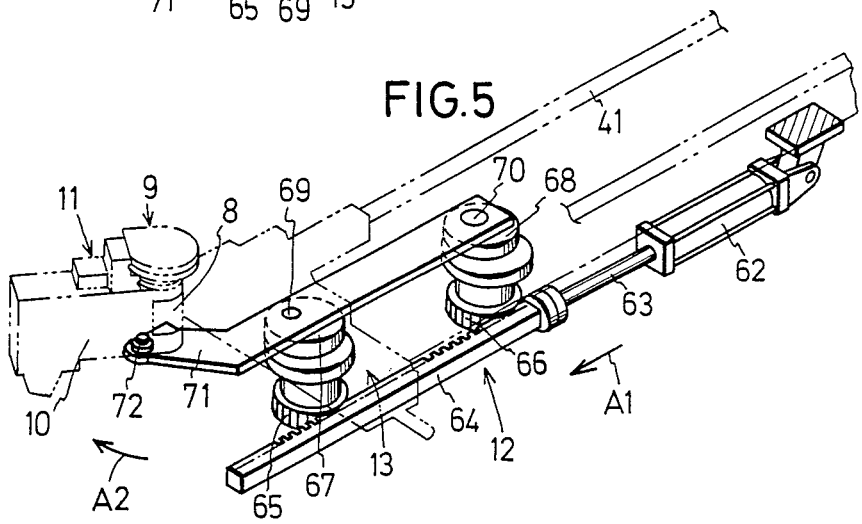
FIG. 5 is a view similar to FIG. 4, the bender-driving apparatus having turned the bending template assembly and the fastening apparatus.
Figure 6:
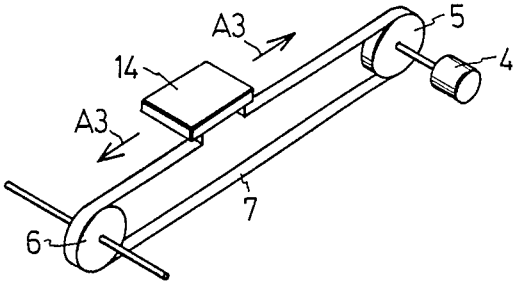
FIG. 6 is a schematic perspective view for explaining the longitudinal transfer of a carriage for work.
Figure 7:
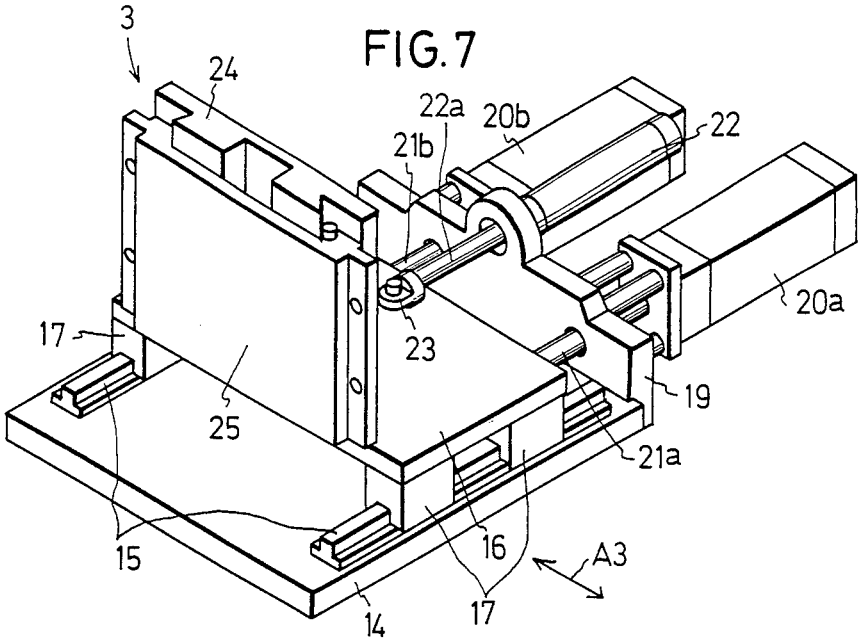
FIG. 7 is a perspective view of the carriage for work.

Now referring to FIGS. 4 and 5, the bender-driving apparatus 12 is described. This apparatus is substantially the same as one disclosed in details in a U.S. Pat. No. 4,552,006. In the upper wall of the bed 1 is fixed a hydraulic cylinder 62 and a rack 64 is connected to a rod 63 of the hydraulic cylinder 62 so that the rack 54 may be disposed in parallel to the rails 2. The rack 64 is in mesh with gears 65, 66, which are mounted inside the bed 1 for rotation around a vertical shaft. Circular cranks 67, 68 are adapted on the gears 65, 66 respectively and are provided, at eccentric positions thereon, with crank pins 69, 70. The crank pins 69, 70 are located to each other so that the axes of them may cross a line parallel to the rails 2 whatever angular position the circular cranks 69, 70 are turned to. A bent link 71 having an obliquely bent front end portion is connected to circular cranks 67, 68 at the crank pins 69, 70. The front end of the bent link 71 is pivotally connected to the bending arm 10 by a ring joint 72 and this bending arm is disposed at right angles to the rails 2 when the rod 63 is retreated to the rear most position while it is adapted to be turned about the main shaft 8 in the clockwise direction in FIG. 5 by an angle corresponding to the stroke of the rod 63 as the rod 63 advances.

Next, the supporting apparatus 13 is described in reference to FIG. 1. A supporter base 73 is secured, at one end thereof, on the base 1 so that it may be disposed at right angles to the rails 2 and a guide rail 74 is fixed on the upper surface of the supporter base 73 similarly at right angles to the rails 2. A supporter 75 is slidably mounted on the guide rail 74 and is adapted to move forth and back in the direction perpendicular to the rails 2.

In the above description, the bending template assembly 9 includes two bending templates but it can include an arbitrary number (two or more) of bending templates. In that case, it is necessary to let hydraulic cylinders of the number equal to that of the bending templates advance the horizontally movable base 16 and to locate the vertically movable base at positions of the number equal to that of the bending templates.

In the operation of the above mentioned bending apparatus, the bending arm 10 is first located at right angles to the rails 2 and then the fastening apparatus 11 and the supporter 75 are kept retreated from the bending template assembly 9. The work 41 to the bent is held in the chuck. The hydraulic cylinder 20*a* is operated and the vertically movable base 25 is lowered, locating the top of the work 41 in the groove 43*a* of the lower bending template 42*a*. The geared motor 4 is rotated so that the portion of the work 41 to be deformed into a bend can be located in the groove 43*a* and the work 41 is advanced by a prescribed distance. Next, the fastening apparatus 11 and the supporter 75 are brought close to the bending template assembly 9, and the work 41 is located in the grooves 43*a*, 61*a* and is pressed against the bending template 42*a* by the fastening piece 60*a*. The supporter 75 is brought close to and into close contact with the work 41. The hydraulic cylinder 62 is actuated in the direction indicated by an arrow A1 and the bending arm 10 is turned in the direction shown by an arrow A2 by a prescribed angle, deforming a part of the work 41 into a bend. The supporter 75 confronting to and contacting with the work 41 prevents the work 41 from being imprudently deformed by the reaction force exerted on the work 41 in the bending operation.

When some bends of different radii of curvature are to be formed on different portions of the same work 41, the bending arm 10 is once returned to the position as shown in FIG. 1 and the supporter 75 is retreated from the work 41. Then the hydraulic cylinder 55 is operated to displace the fastening apparatus from the position shown in FIG. 2 to the position shown in FIG. 3. Furthermore the geared motor 4 is operated to advance the carriage 3 for work so that the portion of the work 41 to be bent at the next step may be situated between the bending template assembly 9 and the fastening apparatus 11. Then the air cylinder 22 is operated to retreat the work 41 by a horizontal distance L1 from the position shown by P1 to the position shown by P2 as shown in FIG. 3. In this case, if the fastening piece 60*a* is merely retreated from the bending template without descending, the work 41 can not be retreated by the distance L1 since the fastening piece 60*a* is an obstacle. The displacement of the fastening apparatus 11 according to the present invention makes possible the retreat of the work 41 by the shown distance L1. Next, the hydraulic cylinder 26 is operated to raise the vertically movable base 25 and to move the work 41 from the position shown by P2 to that shown by P3 by the height H, thereby making the work 41 oppose to the upper bending template 42*b*. Furthermore, the hydraulic cylinder 20*b* is operated to advance the horizontally movable base 16 again and to let the work 41 approach the bending template 42*b* by the horizontal distance L2 from the position shown P3 to that shown by P4. When it is required to change the direction of the plane of bending, i.e., the plane on which a bend to be formed lies, the geared motor 33 is driven to rotate the work 41 by a required angle. The hydraulic cylinder 55 is operated to bring the fastening apparatus 11 again to the position shown in FIG. 2. At this instance, the work 41 is located in the grooves **43*b*, 61*b*. Furthermore, the supporter 75 is advanced. The hydraulic cylinder 62 is operated to turn the bending arm 10** by a desired angle and to form a bend of a radius of curvature substantially equal to that of the bending template.

In the above operation, the transverse displacement of the work 41 characterized by L1, L2 and H occurs after the work 41 is advanced longitudinally but the above transverse displacement can be carried out while the work 41 is being advanced. Moreover, in the above mentioned operation, the rotation of the work 41 occurs after the transverse displacement of the work 41 but the rotation can be carried out during the transverse displacement.

As is apparently seen in the above description, the bending apparatus according to the present invention makes it possible to form bends with different radii of curvature and different planes of bending, effectively in succession, at plural portions of an elongated work without requiring exchange of bending templates. Moreover, since a plurality of bending templates are put in layers in the axial direction of the main shaft and mounted around the main shaft, the radius of the bending template, therefore the radius of curvature of a bend to be formed on the work, can be selected arbitrarily. Furthermore, the transverse displacement of the fastening apparatus characteristic of the present invention can reduce such retreat distance of the fastening apparatus as is necessary for the change of the location of the work.

As many apparently widely different changes and modifications may be possible without departing from the spirit and scope thereof, it should be understood that the present invention is not limited to the specific embodiments thereof except as defined in the appended claims.

What is claimed is:

1. A bending apparatus comprising:

(a) a main shaft mounted on an elongated bed;

(b) a bending template assembly having upper and lower circular bending templates which are stacked in the axial direction of said main shaft around the main shaft for rotation relative to said bed, said upper circular template having a larger radius of curvature than said lower circular template;

(c) a bending arm mounted at one end thereof on said main shaft for turning movement relative to said bed;

(d) a fastening apparatus including a base pivotally supported to said bending arm by first and second parallel links which move said apparatus vertically with respect to said bending template, and toggle linkage means connected between said bending arm and parallel links for moving said parallel links effecting vertical motion of said fastening apparatus, said fastening apparatus rotating with said bending arm relative to said bed;

(e) first and second fastening pieces supported on said base member for linear motion to and from said upper and lower templates, respectively, for grasping and releasing a workpiece against said templates, said first fastening piece being shorter in length than said second fastening piece and being disposed above said second fastening piece, whereby said first and second fastening pieces may be retracted from said templates and moved downwardly along an arc which permits a workpiece to be positioned with respect to either of said templates;

(f) a bender-driving apparatus connected to said bending arm and adapted to turn said arm about said main shaft;

(g) a carriage for supporting a workpiece having a carriage base slidable in the longitudinal direction of said bed and a chuck mounted on said carriage base for movement in a vertical plane perpendicular to the direction of the longitudinal movement of said carriage base;

the rear end of said workpiece being held in said chuck, the portion of said workpiece to be bent being positioned with respect to said bending template assembly by the advance of said carriage and said portion being located against the outer periphery of a desired one of said bending templates by the movement of said chuck in said vertical plane when said fastening apparatus fastening pieces are retracted.

2. A bending apparatus as claimed in claim 1 in which said carriage includes a horizontally movable base movable in the direction perpendicular to the direction of movement of said carriage and adapted to be located at a number of horizontal positions equal to the number of said bending templates, and a vertically movable base supporting said chuck, mounted on said horizontally movable base for vertical movement relative to said horizontally movable base.

3. A bending apparatus as claimed in claim 2 in which said carriage further includes a geared motor secured on said vertically movable base coupled to rotate said chuck by an angle equal to the variation of a selected direction of bending.

4. A bending apparatus as claimed in claim 1 in which said bender-driving apparatus includes a rack mounted in said bed for movement in the longitudinal direction of said bed, a pair of gears in mesh with said rack and rotatable relative to said bed, and a bent link supported pivotally at one end to eccentric positions of said gears and connected pivotally, at another end thereof, to the rotatable portion of said bending arm, whereby a line connecting said eccentric pivot points on said gears of said bent link is always kept parallel to the longitudinal direction of said bed and at a constant length.

5. A bending apparatus as claimed in claim 1 in which a supporting apparatus is further mounted on said bed to support a workpiece between said template and said chuck preventing portions of said workpiece other than that being bent from being imprudently deformed or displaced by the reaction force exerted on said workpiece.

* * * * *